United States Patent [19]

Lewis et al.

[11] Patent Number: 4,796,687

[45] Date of Patent: Jan. 10, 1989

[54] LIQUID/SOLID INTERFACE MONITORING DURING DIRECT CHILL CASTING

[75] Inventors: Brian G. Lewis, Branford; John C. Yarwood, Madison, both of Conn.

[73] Assignee: Olin Corporation, New Haven, Conn.

[21] Appl. No.: 71,836

[22] Filed: Jul. 10, 1987

[51] Int. Cl.[4] ..... B22D 11/16; B22D 27/02

[52] U.S. Cl. ..... 164/455; 164/154; 164/467; 164/503; 164/451

[58] Field of Search ..... 164/451–455, 164/466, 502, 487, 444, 150, 154, 414, 467, 503

[56] References Cited

U.S. PATENT DOCUMENTS 4,446,908 5/1984 Ungarean et al. .
4,495,983 1/1985 Kindlmann et al. .

FOREIGN PATENT DOCUMENTS 8414740 4/1983 France .
48-28256 8/1973 Japan ..... 164/451
58-53363 3/1983 Japan ..... 164/451

OTHER PUBLICATIONS

*Induction Heating Handbook* by J. Davies and P. Simpson, published by McGraw-Hill Company (UK) limited, 1979, pp. 307–313 & 410–411.

*Primary Examiner*—Kuang Y. Lin
*Attorney, Agent, or Firm*—Gregory S. Rosenblatt; Paul Weinstein

[57] ABSTRACT

An apparatus and method for monitoring the liquid/-solid interface position of an alloy ingot being formed by either direct chill or electromagnetically enhanced direct chill casting systems comprising an inductive sensor wire disposed about the mold wall of the casting system, driving the sensor wire to cause a magnetic flux to penetrate into the ingot, and sensing the change in the impedance or components of the impedance of the system. Monitoring the liquid/solid interface position allows ready adjustment to operating controls, such as, containment/stirring inductors, cooling systems and casting parameters, thereby producing a desirable ingot.

44 Claims, 2 Drawing Sheets

LIQUID/SOLID INTERFACE MONITORING DURING DIRECT CHILL CASTING

The present invention relates to methods and devices for monitoring the liquid/solid interface in direct chill and electromagnetically enhanced direct chill casting systems by measuring the change in the impedance of a system by an inductive sensor wire or wires disposed about a solidifying ingot. Monitoring the liquid/solid interface position of a solidifying ingot allows periodic adjustments to operating controls, such as containment/stirring inductors, cooling systems and casting parameters, of a continuous or a semicontinuous direct chill casting system in order to maintain a uniform ingot product.

The direct chill casting, for example, of crack sensitive alloys demands careful control of the cooling conditions, casting parameters and containment/stirring inductors. Critical to the solidification mechanism is not only the water application for cooling but the effective mold length. This is the length of the mold involved in heat extraction and it is determined not only by the physical dimensions of the mold but also by solidification shrinkage and meniscus shape as induced by the conditions imposed.

Direct chill casting and submold cooling is well known. Furthermore, recent developments in the application of electromagnetic fields to direct chill casting processes, such as the CREM process described in French Patent No. 8,414,740 to Vives et al., allows for the control of surface quality and internal structure by a combination of electromagnetic containment and stirring. This results in reduced scalping and edge trimming of the final ingot product.

In the CREM process it is important to maintain a constant liquid/solid interface. It is currently known in direct chill casting to dispose sensors either directly above the solidifying ingot or as floats in the open topped liquid feed. These sensors primarily monitor the head height and, in the case of electromagnetic casting, the size of the ingot. Such sensors are not capable of detecting the liquid/solid interface position. Due to extended cooling and physical support zones provided by the physical mold wall, direct chill casting devices have not had to concern themselves with the liquid/-solid interface position of the solidifying ingot. The use of sub-mold cooling with the concomitant impact on effective mold length, and the advent of electromagnetically enhanced direct chill systems have resulted in a desire to monitor, inter alia, the liquid/solid interface position of the solidifying ingot.

The application of sensors is much more prevalent in electromagnetic casting arts due to the need to adjust the operating parameters in order to obtain the desired casting stability, and dimensions for the ingot being cast.

For instance, U.S. Pat. No. 4,682,645 and entitled "CONTROL SYSTEM FOR ELECTROMAGNETIC CASTING OF METALS" describes the use of loops to sense an electrical parameter of the casting system, e.g. mutual inductance between at least one sense loop and a containment inductor, to control head height and/or ingot size during casting. Although this patent satisfactorily measures an electrical parameter permitting the control of head height and/or ingot size during casting, it provides no means for monitoring the liquid/solid interface position of the ingot. The mutual inductance of the sense wire relative to the containment inductor primarily measures the air gap between the sensor and the surface, as defined by flux penetration, of the ingot being cast. That is, a change in air gap dominates the corresponding change in the sensed mutual inductance.

U.S. Pat. No. 4,495,983, entitled "DETERMINATION OF LIQUID/SOLID INTERFACE AND HEAD IN ELECTROMAGNETIC CASTING", is extremely pertinent to the present invention. U.S. Pat. No. 4,495,983 describes a means for determining the molten metal head and liquid/solid interface positions during an electromagnetic casting run by utilizing the in-phase component of the voltage across the inductor as an indicator of head and interface position. It is the primary purpose of U.S. Pat. No. 4,495,983 that the molten metal head and liquid/solid interface positions are measured via the system equivalent series resistance without the need for inserting or placing probes or other devices into the primary casting zone and without requiring alteration in the construction of the inductor, non-metallic shield or other primary elements of the electromagnetic casting apparatus. It is the primary premise of this patent that if all system parameters are known or monitored except the load liquid/solid interface position, then the resistance of the load seen at the inductor terminals changes as the load liquid/solid interface moves up and down within the casting zone.

One deficiency of U.S. Pat. No. 4,495,983 is that the inductor has two functions which are mutually exclusive such that if the frequency of the inductor is altered so as to alter the containment parameters of the electromagnetic field to restrict the molten metal height or width of the ingot, then such adjustments would have a corresponding affect on the penetration flux generated by the inductor and would thus alter the accuracy of the liquid/solid interface position detector.

Thus, it is preferable to have an exclusive means for sensing the liquid/solid interface position independent of the containment inductor. Furthermore, the use of an electromagnetic containment inductor as a sensor in direct chill casting devices to monitor the liquid/solid interface position would not provide satisfactory readings due to the loss of magnetic flux caused by the casting mold walls at high frequencies or loss of resolution at penetrating low frequencies. Typically, containment inductors in electromagnetic casting devices are driven at high frequencies in the Kilohertz range which permit control over ingot sizing but which result in poor flux penetration. The inventors of the present invention have discovered that a degree of flux penetration into the solidifying ingot is required in order to provide an adequate change in impedance of the system caused by movement of the liquid/solid interface position. Thus, containment inductors used as sensors would not provide the high flux penetration required in monitoring the liquid/solid interface position, when applied to direct chill casting devices having good conductivity mold walls. Nor would it be a suitable sensor means for an electromagnetically enhanced direct chill process, such as the CREM process, which not only includes mold walls but also uses low frequencies, e.g. 50 Hz, implying poor resolution.

Infrared radiation detection, set forth in U.S. Pat. No. 4,446,908, entitled "INFRARED IMAGING FOR ELECTROMAGNETIC CASTING", is another means utilized in electromagnetic casting for detecting the position of the liquid/solid interface. In accordance with this patent, radiation signals are transmitted by filaments secured within elements of the electromagnetic casting system to a signal processor which enables readout display of electromagnetic casting parameters, such as liquid temperature, maximum load temperature, position of liquid/solid interface, and head position.

Another means for measuring head top surface location of an ingot being cast by electromagnetic casting systems is disclosed in U.S. Pat. No. RE32596. This patent discloses a means for monitoring the head top surface location of an ingot during electromagnetic casting by utilizing the current being induced in an existing electromagnetic mold screen or shield, either alone or with other electrical parameters, as an indicator of top head surface location.

Many other means for measuring top head location of an ingot have been known, such as insertion of sensors and floats directly into the ingot being cast.

None of the aforementioned teachings for liquid/solid interface or top head sensors applied in the electromagnetic casting arts would provide satisfactory detection of the liquid/solid interface position of an ingot being formed by direct chill casting due to low flux penetration and interference caused by the mold walls of such a system. Furthermore, the mutual inductive sensors discussed above would not permit simultaneous adjustments to the magnetic field used for containment since any adjustment to the inductor would have a corresponding affect upon the liquid/solid interface sensor.

Thus, the present inventors have uncovered new processes and apparatuses which permit the monitoring of liquid/solid interface position in direct chill castings which overcome the disadvantages of the prior art sensors. Furthermore, the present invention permits independent monitoring of the liquid/solid interface position and control of containment/stirring inductors, cooling systems and casting parameters. It also provides for a sensor capable of generating the required flux penetration into the solidifying ingot which in turn permits accurate detection of any change in the impedance of the casting system directly corresponding to a change in the liquid/solid interface position. These and other advantages of the present invention are further described and inferred here below.

It is the object of the present invention to provide an apparatus and process for monitoring the liquid/solid interface position in an ingot, of a metal alloy such as copper or aluminum, being formed by a direct chill casting system comprising an inductive sensor wire disposed about the inside surface of the mold wall in a direct chill casting system; a direct power source for driving the inductive sensor wire thereby causing a magnetic flux to penetrate to a predetermined depth into the ingot; and means for sensing a change in the impendance of the system.

Additionally, it is an object of the present invention that the current to the sensor wires is provided from a power source, wherein the frequency is in the range between 0.5 to 20 kHz. The inductive sensor wire is insulated by a ceramic coating or plate and is disposed at or near the inner surface of the mold wall. The means for sensing a change in the impedance of the system being an inductive sensor wire connected to an impedance analyzer or like electronic measuring system. The system output may be used in a control loop to adjust or maintain the containment/stirring inductors, cooling systems or casting parameters.

According to the present invention, the inductive sensor wire is positioned at a height which is preferably at or near the meniscus of the forming ingot and is driven by a low power source typically, but not limited to, of less than 200 Watts.

An additional object of the present invention is that the sensor wires may also be disposed in the mold wall for monitoring the liquid/solid interface position of an ingot being formed by an electromagnetically enhanced direct chill casting system. When using the inductive sensor wires with an electromagnetically enhanced direct chill system, the frequency used to drive the magnetic flux generated by the inductive sensor wire is sufficiently greater than the frequency used to drive the flux generated by the electromagnetic containment coil (inductor) to prevent electrical interference.

Additional embodiments of the present invention permit the application of at least second and third inductive sensor wires to permit greater sensitivity to the liquid/solid interface position and provide a correction factor based on movement of the solidifying ingot meniscus and shrinkage of the solidified ingot shell.

These and further features, objectives and advantages of the present invention will become more apparent from the following description of several preferred embodiments of our invention when taken in conjunction with the accompanying drawings which show, for illustrative purposes only, the several presently preferred embodiments of our invention and wherein.

To maintain appropriate systems control, it is necessary to monitor the liquid/solid interface position of the solidifying ingot being cast by either a direct chill or an electromagnetically enhanced direct chill casting system. Being able to detect the liquid/solid interface position will permit subsequent adjustments by a system controller to containment/stirrer inductors, cooling systems and casting parameters. We are unaware of any accurate means for detecting and monitoring the liquid/solid interface position in a direct chill casting system.

Figure 1:
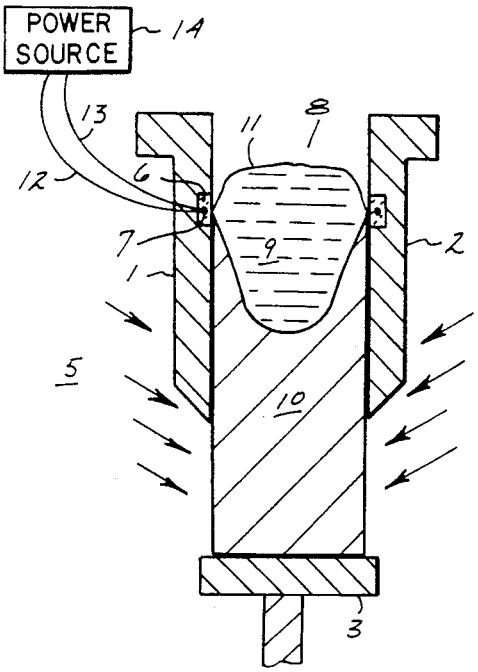
FIG. 1 is a cross-sectional view of a direct chill casting system having an inductive sensor wire disposed in the mold wall thereof.

Referring to FIG. 1, one embodiment of the present invention will now be described. FIG. 1 is a representational cross-sectional view of a direct chill casting system having mold walls 1 and 2, starter block 3, which is vertically adjustable, and coolant 5. In accordance with FIG. 1, the direct chill casting system provides for submold cooling directly by coolant 5. A sensor wire 7 is disposed about the inner surface of mold walls 1 and 2. It is necessary that sensor wire 7 be insulated from both the mold and the alloy ingot 8 by an insulator 6, such as a ceramic coating or plate. It is preferable that sensor wire 7 be positioned close to the inner surface of the mold wall, typically less than 3 millimeters. Ingot 8 consists of a liquid portion 9 and a solid portion 10. The meniscus 11 is the curved liquid surface linking the flat upper surface to the point where the liquid solid interface intersects the outer surface of the solidifying ingot.

Inductive sensor wire 7 may be made of either a copper wire or tape, or any other conductive element. Inductive sensor wire 7 is connected to a power source 14 via electrical connectors 12 and 13, which may be of any conductive material or wire. Power source 14 can be the drive source from an impedance analyzer or an independent source which permits adjustment to the wattage and frequency used to drive inductive sensor wire 7 and thus allows for direct control of the penetration depth of the magnetic flux into ingot 8. Furthermore, power source 14, in combination with inductor sensor wire 7, is used to detect any change in the impedance of the system which results from a change in the liquid/solid interface position.

As a liquid metal alloy, such as a copper alloy, is poured into the direct chill mold, starter block 3 begins to move in a direction opposite from the point in which the alloy is being introduced to the system. As the liquid metal alloy contacts mold walls 1 and 2 it begins to form solid 10 as heat is extracted into the primary coolant. As starter block 3 moves downwardly the partially or fully solidified ingot leaves the confines of casting molds 1 and 2 wherein it is subjected to direct secondary submold coolant 5. Thus, it is an object of the present invention that inductive sensor wire 7 be disposed at a height within the mold walls 1 and 2 in order to monitor changes to the liquid/solid interface position, thereby providing input for a controller that will make adjustments in the casting parameters to deter undesirable alterations to the ingot being cast.

Having the capability of monitoring the liquid/solid interface position permits adjustment to containment/-stirring inductors, cooling systems and casting parameters. Such adjustments allow for the formation of a more consistant ingot of desired shape and metallurgical structure.

Inductive sensor wire 7 is electrically driven at a predetermined frequency to allow the magnetic flux generated by inductive sensor wire 7 to penetrate into ingot 8 to a predetermined skin depth. Impedance (Z) of the direct chill casting system is determined by the ratio of open circuit voltage ($V_{oc}$) to the current drive ($I_D$), such that Z equals $V_{oc}/I_D$. Since the impedance (Z) consists of inductance (L), and resistance r, which can be extracted from the voltage, current and phase information, all elements of the system impedance can be monitored. This flux penetration depth (skin depth δ) is given by the square root of the quotient of electrical resistivity ($\rho_e$) and angular frequency ($\omega$), wherein $$\delta = \sqrt{\frac{2\,\rho_e}{\mu_o \omega}}$$

with $\mu_o$ being the permeability of free space. This skin depth defines flux and current distribution in the system and consequently effects L and r in a predictable fashion. Thus, as the electrical resistivity increases, or the frequency is lowered, the flux penetration increases and there will be a change in L and r.

The following Example illustrates the application of the flux penetration depth formula.

EXAMPLE 1

The electrical resistivity ($p_e$) of both copper and aluminum at slightly above the melting point is $0.21\times10^{-6}$ Ωm. The free space permeability ($\mu_o$) is $4\pi\times10^{-7}\,Hm^{-1}$ and the angular frequency (w) is $2\pi f$ is the frequency.

In the MKS system, the units of resistivity are $ML^2T^{31}\ {}^1Q^{-2}$, frequency $T^{-1}$ and permeability $MLQ^{-2}$. M represents mass, L length, T time and Q charge.

Substituting these values into the equation, $$\delta=\sqrt{2(0.21\times10^{-6})/(4\pi\times10^{-7})(2\pi)f}$$

$$\delta=0.461\sqrt{1/f}$$

for f=0.5 kHz, $\delta=0.461\times0.141=0.0652$ m=6.5 mm for f=20 kHz, $\delta=0.461\times0.024=1.0103$ m=1.03 mm The resistivity is temperature dependent. Increasing the temperature will increase skin depth penetration. At elevated temperatures, skin depth penetrations of up to about 10 mm are obtained.

Clearly, as the ratio of solid to liquid, and therefore the spatially averaged electrical resistivity in the vicinity of inductive sensor wire 7, changes so the effective flux penetration changes.

Thus, the present inventors have discovered that by detecting the changes in the components of the impedance (Z) of the direct chill casting system one may monitor the liquid/solid interface position. That is, a change in these parameters corresponds to a proportional change in the position of the liquid/solid interface.

Figure 2:
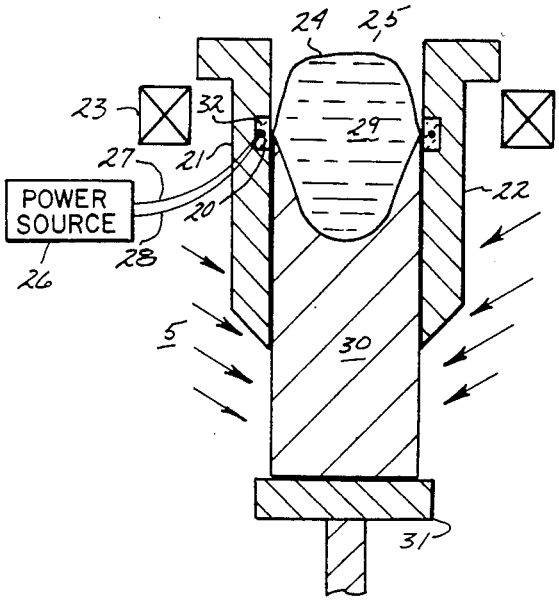
FIG. 2 is a cross-sectional view of an electromagnetically enhanced direct chill casting system having an inductive sensor wire disposed in the mold wall thereof.

FIG. 2 depicts another embodiment according to the present invention, wherein an inductive sensor wire 20 is disposed about mold walls 21 and 22 of an electromagnetically enhanced direct chill casting system. The primary distinction between this embodiment and that described in FIG. 1 is the addition of electromagnetic coil 23 disposed about the upper portion of molds 21 and 22 for the purpose of controlling the formation of meniscus 24 of ingot 25 by magnetic flux while providing internal stirring of the metal. The inductive sensor wire 20 monitors a liquid/solid interface in the same manner as that set forth in the description with regard to FIG. 1. Power source 26 is electrically connected to sensor wire 20 via conduits 27 and 28 to drive the magnetic flux generated by the inductive sensor wire 20 at a frequency in the range between 0.5 to 20 kHz, wherein electromagnetic coil 23 is driven by a much lower frequency, approximately 50 Hz. It is important in electromagnetically enhanced direct chill casting processes that the liquid/solid interface position be monitored since there is a significantly greater liquid meniscus above the liquid/solid interface due to containment off the mold wall within the region than normally exists in DC casting systems. FIG. 2 also depicts a liquid ingot portion 29, a solidified ingot portion 30 and starter block 31. Furthermore, sensor wire 20 is insulated by insulation material 32. Thus, inductive sensor wire 20, according to the present invention, monitors the liquid/solid interface position of ingot 25, which signals a systems controller in order to adjust, inter alia, the magnetic flux generated by electromagnetic coil 23 to maintain proper containment conditions resulting in the formation of the desired meniscus and ingot shapes. Accordingly, it is has been discovered by the present inventors that sensor wire 20 should be driven by a power source independent of that which drives electromagnetic coil 23 in order to simultaneously monitor the liquid/solid interface and adjust the operating parameters of the CREM process.

Figure 3:
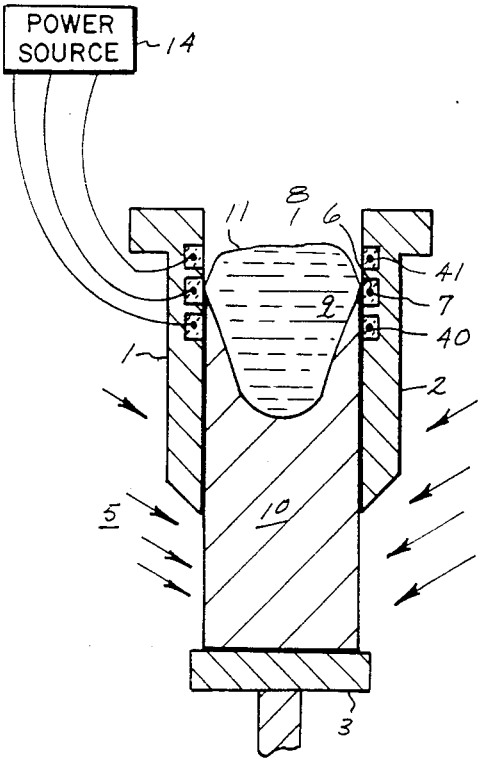
FIG. 3 is a cross-sectional view of another embodiment according to the present invention incorporating three inductive sensor wires disposed therein.

In order to ensure extremely accurate detection of the liquid/solid interface position, FIG. 3 depicts another embodiment of the present invention which utilizes multiple inductive sensor wires. FIG. 3 shows second and third inductive sensor wires 40 and 41, respectively, disposed on opposite sides of sensor wire 7. The multiple sensor wires allow four variables of operation. First, inductive sensor wire 7 may be inserted into the direct chill casting system by itself, as described in FIG. 1 above, and function as a stand alone monitor providing an output impedance (Z) which corresponds to the liquid/solid interface position of ingot 8. Sensor wire 7 would be positioned in a vertical plane dictated by a predetermined level in the mold (preset by an upper surface monitor). Fine tuning of the components of Z versus the liquid/solid interface can be achieved via standard calibration experiments including bench modeling.

Secondly, it is envisioned that sensor wires 7 and 40 may be used in combination to give greater sensitivity to variations in the liquid/solid interface position by detecting and allowing for shrinkage of the solidified ingot shell. Changes in the extent of shrinkage will effect the detected system impedance even at constant liquid/solid interface position. Such changes would influence the measurement of single sensor wire 7 which could then be corrected by a factor based on the reading from sensor wire 40. In addition, this arrangement provides greater latitude in the original setting of the liquid residence position. Accordingly, sensor wires 7 and 40 will provide outputs of the components of $Z_1$ and $Z_2$, respectively, which can be electrically co-processed against a calibration curve to give greater accuracy in monitoring the liquid/solid interface position. Inductive sensor wire 7 is typically spaced 2–3 centimeters from inductive sensor wire 40.

Thirdly, inductive sensor wire 7 may be used in combination with inductive sensor wire 41 to provide a correction factor based on movement in meniscus 11. Changes in the proximity of the liquid meniscus 11 to the mold wall will change the detected impedance of the system, even at a fixed liquid/solid interface. Such movements would influence the measurement of single sensor wire 7 which could then be corrected by a factor based on the reading from inductive sensor wire 41.

Fourthly, it is envisioned that all three conductive sensor wires 7, 40 and 41 may be disposed about mold walls 1 and 2 in order to provide greater sensitivity to variations in the liquid/solid interface position and also provide correction means for movement of the meniscus 11 and the degree of shrinkage of the shell.

Good flux penetration generated by inductive sensor wires 7, 40 and 41 can be achieved at low frequency; however, there is then poor resolution of electrical resistance and other components contributing to the system's impedance. Good resolution is possible at higher frequencies; however, flux penetration is then poor. It is essential that sufficient flux penetrates into the ingot to allow satisfactory detection of changes in both impedance and electrical resistance. Frequencies in the range between 0.5 to 20 kHz normally provide sufficient flux penetration and satisfactory resolution of impedance and electrical resistance depending on the electrical resistivity of the metal being cast.

Figure 4:
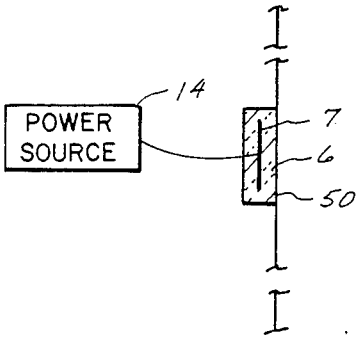
FIG. 4 is a cut out cross-sectional view of the sensor wire according to the present invention.
Figure 5:
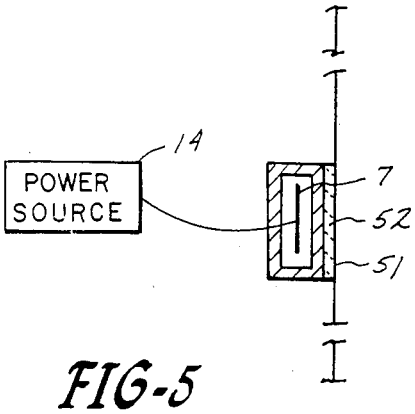
FIG. 5 is a cut out cross-sectional view of another embodiment of the inductive sensor wire according to the present invention.

The optimum situation is one where the inductive sense wire is disposed at the inside front wall of the casting mold. This can be accomplished in accordance with either embodiment demonstrated in FIGS. 4 and 5. FIG. 4 depicts an inductive sensor wire 7 connected to power source 14 wherein inductive sensor wire 7 is embedded no more than 3 millimeters from the interior wall of the mold. Sensor wire 7 is insulated by ceramic material 6 from the front plate or wall 50. FIG. 5 depicts another embodiment according to the present invention, wherein front wall 51 is notched out to allow for sensor wire 7 which is insulated from the ingot by a ceramic coating or plate 52, and metal container 53.

The position of inductive sensor wire 7 near the inside front wall of molds 1 and 2 permits the use of frequencies in the range of between 0.5 to 20 kHz. These frequencies may be driven by a power source of less than 200 watts. For example, if sensor wire 7 is recessed 3 millimeters from the interior front wall of molds 1 and 2, it would be limited to frequencies less than or equal to 1 KHz, unless a higher power source is used to achieve adequate signal strength. In situations where a high power source is utilized, it would still be resolution limited based on the choice of frequency.

It should also be noted that some or all of the sensor wires can be driven as inductors or alternatively none of them driven, there being a master inductor located near the inner surface of the mold, wherein the mutual impedance between the master inductor and the sensor wires becomes the monitored variable.

Figure 6:
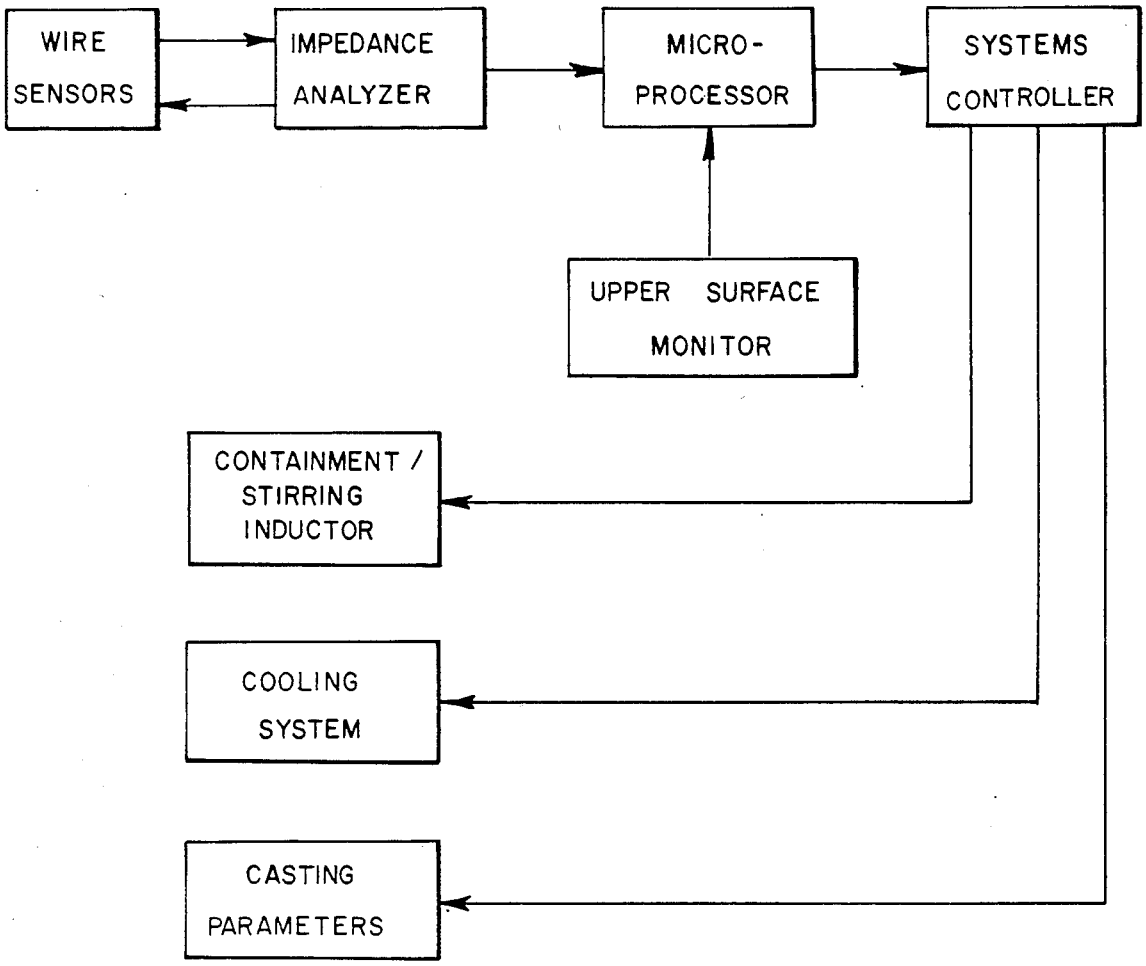
FIG. 6 is a block diagram of the system according to one embodiment of the present invention.

FIG. 6 demonstrates that an impedance monitor can be used to drive the wire sensor (inductive sensor wire) at a desired frequency. As the penetration flux changes due to movement in the liquid/solid interface position within the direct chill mold, the wire sensor, which continuously monitors the impedance of the system, sends a signal to the impedance monitor, which is connected to a microprocessor for comparing the signal received against predetermined constants. In the case of multiple wire sensors a co-processor would analyze the data detected by each of the sensor wires. If the impedance of the system has changed corresponding to a change in the liquid/solid interface position, then the microprocessor will signal a systems controller to adjust the operating conditions of, for example, the containment/stirring inductors, cooling systems and casting parameters in order to maintain a high quality ingot. When using a lower sense wire 40, as set forth in FIG. 3, a shell shrinkage monitor signals directly to the micro-processor or co-processor to adjust for any associated correction factors. In a similar way, when using an upper sensor wire 41, a meniscus monitor signals directly to the microprocessor or coprocessor to adjust for any correction factors due to the change in liquid meniscus separation from the mold wall. An upper surface monitor may also be used to signal the microprocessor or coprocessor to adjust for any correction factors due to the change in the overall mold level.

EXAMPLE 2

A static chill casting mold having $5\frac{1}{2}'' \times 3\frac{1}{2}''$ ceramic (castable) side walls on a chill block was equipped with a single turn coil of copper wire around the mold (hereinafter referred to as sensor wire). The sensor wire was driven by a Hewlett-Packard low frequency impedance analyzer at a frequency of approximately 1 kHz. A 15 lb. melt of C194 was poured into the ceramic mold generating the results set forth in Table I here below.

TABLE I

| Time (secs) | L (μH) 0 | r (Ω) 0 |
|---|---|---|
| Pour (0) | −0.0295 | −0.0011 |
| 20 | −0.0292 | −0.0010 |
| 45 | −0.0283 | −0.0001 |
| 60 | −0.0275 | +0.0002 |
| 90 | −0.0254 | +0.0028 |

As the solidification front passed through the plane of the sense wire changes in both inductance (L) on the order of 10–20% and electrical resistance (r) of several hundred percent were observed. That is, as the liquid began to solidify and the ratio of liquid/solid in the vicinity of the sensor changed, changes in inductance and electrical resistance were detected. Since changes in inductance and electrical resistance correspond to changes in the spatial electrical resistivity average, it is apparent that a change in the position of the liquid/solid interface has been observed.

All references and citations cited herein shall be incorporated in their entireties.

While we have shown and described several embodiments in accordance with our invention, it is to be clearly understood that the same are susceptible to numerous changes and modifications apparent to one skilled in the art. For example, the position of the sensor wires and the frequency in which they are driven may be adjusted, in accordance with the specific alloy used to form the ingot. Therefore, we do not wish to be limited to the details shown and described but intend to cover all such changes and modifications which come within the scope of the appended claims.

We claim:

1. An apparatus for monitoring the liquid/solid interface position of an ingot being formed by a direct chill casting system having mold walls, starter block and coolant, said apparatus comprising:

an inductive sensor wire disposed within about 3 mm of the inner surface of said mold wall of the direct chill casting system;

a direct power source means for driving said inductive sensor wire causing a magnetic flux to penetrate into said ingot; and means for sensing a change in the impedance of said system.

2. An apparatus according to claim 1, wherein said direct power source means provides a magnetic flux, said flux penetration is a function of the frequency of said power source.

3. An apparatus according to claim 1, wherein said inductive sensor wire is insulated from both said mold wall and said ingot.

4. An apparatus according to claim 3, wherein the insulation is a ceramic coating or plate.

5. An apparatus according to claim 1, wherein said means for sensing a change in the impedance of said system is said inductive sensor wire connected to an impedance monitor.

6. An apparatus according to claim 7, wherein said impedance monitor sends a signal to a microprocessor which in turn signals a systems controller.

7. An apparatus according to claim 1, wherein said inductive sensor wire is positioned at a height which is preferably at or near the meniscus of said ingot.

8. An apparatus for monitoring the liquid/solid interface position of an ingot being formed by an electromagnetically enhanced direct chill casting system having mold walls, starter block and coolant, said apparatus comprising:

an inductive sensor wire disposed within about 3 mm of the inner surface of the mold wall of the electromagnetically enhanced direct chill casting system;

a direct power source means for driving said inductive sensor wire causing a magnetic flux, said magnetic flux being independent from the flux generated by the electromagnetic coil, to penetrate into said ingot; and means for sensing a change in the impedance of said system.

9. An apparatus according to claim 8, wherein said inductive sensor wire is disposed between said electromagnetic coil and the exterior of said ingot.

10. An apparatus according to claim 9, wherein said inductive sensor wire is insulated from both said mold wall and said ingot.

11. An apparatus according to claim 10, wherein the insulation is a ceramic coating or plate.

12. An apparatus according to claim 8, wherein said means for sensing a change in the impedance of said system is said inductive sensor wire connected to an impedance monitor.

13. An apparatus according to claim 12, wherein said impedance monitor sends a signal to a microprocessor which in turn signals a systems controller.

14. An apparatus according to claim 8, wherein said inductive sensor wire is positioned at a height which is preferably at or near the meniscus of said ingot.

15. An apparatus according to either claim 1 or 8, wherein a second inductive sensor wire for generating a secondary magnetic flux is disposed parallel to the first inductive sensor wire.

16. An apparatus according to claim 15, wherein said first and second inductive sensor wires are spaced 2–3 cm apart.

17. An apparatus according to claim 15, wherein means for sensing a change in the impedance of said system is said first and second inductive sensor wires connected to an impedance monitor.

18. An apparatus according to claim 17, wherein said impedance monitor sends the signals generated by said first and second inductive sensor wires to a co-processor for processing.

19. An apparatus according to claim 15, wherein said second inductive sensor wire is positioned below said first inductive sensor wire; whereby greater sensitivity to said liquid/solid interface position is achieved.

20. An apparatus according to claim 15, wherein said second inductive sensor wire is positioned above said first inductive sensor wire; whereby a correction factor based on movement of the ingot meniscus is obtained.

21. An apparatus according to claim 15, wherein a third inductive sensor wire for generating a magnetic flux is disposed parallel to said first and second inductive sensor wires, wherein said third inductive sensor wire is positioned above said first inductive sensor wire and said second inductive sensor wire is positioned below said first inductive sensor wire.

22. An apparatus according to claim 21, wherein means for sensing a change in the impedance of said system is said first, second and third inductive sensor wires connected to an impedance monitor.

23. An apparatus according to claim 22, wherein said impedance monitor sends the signals generated by said first, second and third inductive sensor wires to a co-processor for processing.

24. A process for monitoring the liquid/solid interface position of an ingot being formed by a direct chill casting system having mold walls, starter block and coolant, said process comprising:

positioning an inductive sensor wire within about 3 mm of the inner surface of said mold walls of said direct chill casting system;

driving said inductive sensor wire at a predetermined frequency to generate a magnetic flux which penetrates into said ingot; and sensing a change in the impedance of said system.

25. A process according to claim 24, wherein the change in the impedance of said system is sensed by said inductive sensor wire connected to an impedance monitor.

26. A process according to claim 25, wherein said impedance monitor sends a signal to a microprocessor which in turn signals a systems controller, thereby causing an adjustment to at least one of the following operating controls: containment/stirring inductors, cooling systems and casting parameters.

27. A process according to claim 24, wherein said inductive sensor wire is driven at a frequency in a range between 0.5 to 20 kHz.

28. A process according to claim 24, wherein said magnetic flux generated by said inductive sensor wire penetrates into said ingot to a depth in the range between 1 to 10 mm.

29. A process according to claim 24, wherein said inductive sensor wire is positioned at a height which is preferably at or near the meniscus of said ingot.

30. A process for monitoring the liquid/solid interface position of an ingot being formed by an electromagnetically enhanced direct chill casting system having mold walls, starter block and coolant, said process comprising:

positioning and inductive sensor wire within about 3 mm of the inner surface wall of said mold wall of said electromagnetically enhanced direct chill casting system;

driving an inductive sensor wire at a predetermined frequency to generate a magnetic flux which penetrates into said ingot and which is independent of the flux generated by an electromagnetic coil; and sensing a change in the impedance of said system.

31. A process according to claim 30, wherein the change in the impedance of said system is sensed by said inductive sensor wire connected to an impedance monitor.

32. A process according to claim 31, wherein said impedance monitor sends a signal to a microprocessor which in turn signals a systems controller, thereby causing an adjustment to at least one of the following operating controls: containment/stirring inductors, cooling systems and casting parameters.

33. A process according to claim 30, wherein said inductive sensor wire is driven at a frequency in a range between 0.5 to 20 kHz.

34. A process according to claim 30, wherein said magnetic flux generated by said inductive sensor wire penetrates into said ingot to a depth in the range between 1 to 10 mm.

35. A process according to claim 30, wherein said inductive sensor wire is positioned at a height which is preferably at or near the meniscus of said ingot.

36. A process according to claim 30, wherein said inductive sensor wire is driven by a power source less than 200 Watts.

37. A process according to claim 33, wherein said frequency used to drive the inductive sensor wire is greater than the frequency used to drive said electromagnetic coil.

38. A process according to either claim 24 or 30, which includes driving a second inductive sensor wire to generate a second magnetic flux, said second inductive sensor wire being positioned parallel to said first inductive sensor wire.

39. A process according to claim 38, wherein said second inductive sensor wire is positioned below said first inductive sensor wire; whereby greater sensitivity to said liquid/solid interface position is achieved.

40. A process according to claim 38, wherein said second inductive sensor wire is positioned above said first inductive sensor wire; whereby a correction factor based on movement of the ingot meniscus is obtained.

41. A process according to claim 38, which includes driving a third inductive sensor wire to generate a magnetic flux, said third inductive sensor wire being positioned parallel to said first and second inductive sensor wire, wherein said third inductive sensor wire is positioned above said first inductive sensor wire and said second inductive sensor wire is positioned below said first inductive sensor wire.

42. A process according to either claim 24 or 30, wherein the components of impedance such as inductance and electrical resistance are also sensed.

43. A process according to claim 38, wherein the frequency of the first inductor sensor wire differs from the frequency of the second inductor sensor wire.

44. A process according to claim 41, wherein the frequencies used to drive the first, second and third inductor sensor wires are all different.

* * * * *